US005367805A

United States Patent [19]

Bates

[11] Patent Number: 5,367,805

[45] Date of Patent: Nov. 29, 1994

[54] APPARATUS FOR HYDRAULICALLY POWERING A MOVING DISPLAY

[76] Inventor: Gary Bates, 24765 Bell Rd., New Boston, Mich. 48164

[21] Appl. No.: 12,899

[22] Filed: Feb. 3, 1993

[51] Int. Cl.[5] ..... G09F 19/00

[52] U.S. Cl. ..... 40/406; 40/412; 446/166; 239/20

[58] Field of Search ..... 40/406, 407, 409, 411, 40/412; 446/166, 483; 239/17, 20, 211

[56] References Cited

U.S. PATENT DOCUMENTS

| | | | |
|---|---|---|---|
| 1,064,873 | 6/1913 | Thowless | 40/406 |
| 1,635,978 | 7/1927 | Ross | 446/483 X |
| 2,884,200 | 4/1959 | Konikson | 40/412 X |
| 3,665,638 | 5/1972 | Weistrop | 446/166 |
| 4,413,778 | 11/1983 | Middlemiss | 40/406 X |

*Primary Examiner*—Brian K. Green
*Attorney, Agent, or Firm*—Brooks & Kushman

[57] ABSTRACT

Provided is an apparatus and method for hydraulically powering a moving display. In accordance with the apparatus, there is provided a housing having an actuating member affixable thereto. There is further provided a reservoir means in fluid communication with the housing for storing a liquid and a pump in fluid communication with the reservoir and housing for pumping the liquid into the housing at a selected orientation and rate of flow. A liquid receiving cup is disposed within the housing and affixed to the actuating member such that the cup may be lowered within the housing by the weight of the received liquid. A distance limitation member proximate the liquid-receiving cup is provided for restricting the vertical distance the cup may travel within the housing and facilitating the release of the received liquid. The actuating member is actuated in timed relation to the vertical movement of the cup within the housing so as to power a mechanical or electrical display or the like.

8 Claims, 3 Drawing Sheets

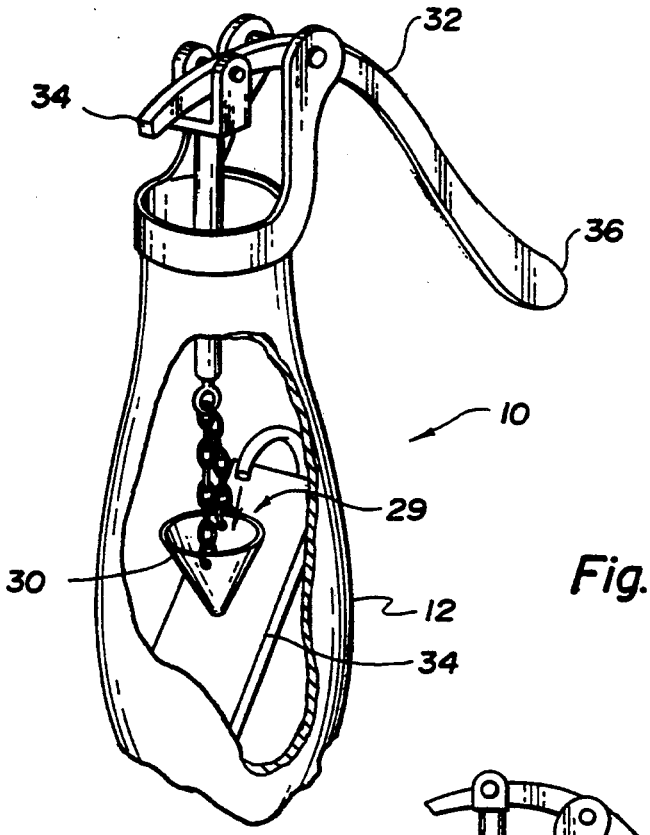
Fig. 1
Fig. 8
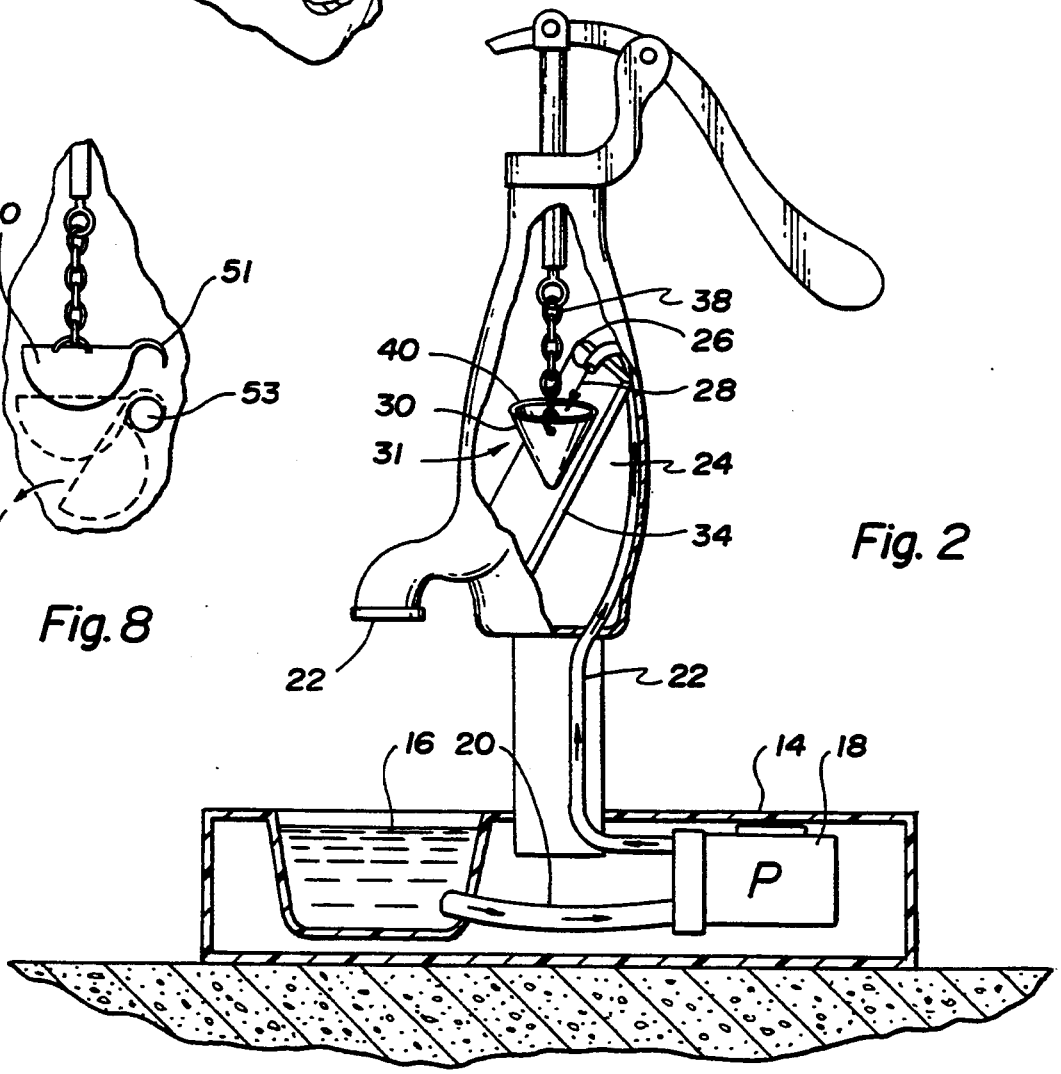
Fig. 2

APPARATUS FOR HYDRAULICALLY POWERING A MOVING DISPLAY

TECHNICAL FIELD

This invention relates generally to a self-contained fountain arrangement for decorative, visual display and utility purposes. More particularly, the invention relates to a method and apparatus for hydraulically powering a moving display.

BACKGROUND OF THE INVENTION

Various attempts have been made by those skilled in the art to develop environmentally safe and visually pleasing fountain arrangements for providing water to agricultural crops and the like and protecting the same from pests. See, for example, U.S. Pat. No. 3,799,105 issued to Porter which discloses a rotary structure supported for movement about a generally vertical axis which further carries a plurality of weighted lines that are revolved to provide selected sight and sound stimuli patterns. See also, U.S. Pat. Nos. 2,884,200 issued to Konikson and 4,413,778 issued to Middlemiss which are directed to hydraulically powered moving displays and decorative fountain arrangements.

As is readily seen, the referenced prior art include numerous parts which, though generally inexpensive to manufacture, are prone to breakage, and thus costly to maintain.

SUMMARY OF THE INVENTION

The present invention overcomes the difficulties of the referenced prior art by providing a simple and inexpensive method and apparatus for hydraulically powering a moving display for ornamentation or utility purposes such as those discussed above.

Accordingly, it is a general object of the present invention to provide a simple and inexpensive apparatus for hydraulically powering a moving display.

A more specific object of the present invention is the provision of a method and apparatus for hydraulically powering a moving display through the use of an actuating member which is actuated in timed relation to the vertical movement of a liquid receiving cup within a housing.

In accordance with the invention, there is provided a housing having an actuating member affixable thereto. There is further provided reservoir means such as a pond or storage tank interior or exterior to said housing and in fluid communication therewith for storing a liquid. Pump means is further provided in fluid communication with the reservoir means and housing for pumping the liquid into the housing at a selected orientation and rate of flow. A liquid receiving cup is disposed within the housing and affixed to the actuating member such that the cup may be lowered within the housing by the weight of the received liquid. Finally, distance limitation means proximate the liquid receiving cup is provided for restricting the vertical distance the cup may travel within the housing and facilitating the release of the received liquid. Accordingly, the actuating member is actuated in timed relation to the vertical movement of the cup within the housing so as to power a mechanical or electrical display or the like for ornamental or utility purposes.

Also in accordance with the invention, there is provided a method of hydraulically powering a display which includes the steps of providing a housing having an actuating member affixable thereto and providing reservoir means such as a pond or storage tank in fluid communication with the housing. A liquid receiving cup is also disposed within the housing and affixable to the actuating member. The method further includes the step of pumping liquid from the reservoir into the housing at a selected orientation for receipt by the cup such that the cup is lowered within the housing by the weight of the received liquid. The vertical distance the cup may be lowered within the housing is restricted and the liquid received by the cup is released such that the actuating member is actuated in timed relation to the vertical movement of the cup within the housing to power the moving display.

These and other objects, features and advantages of the present invention are readily apparent from the following detailed description of the best mode for carrying out the invention when taken in connection with the accompanying drawings.

BRIEF DESCRIPTION OF THE DRAWINGS

FIG. 1 is a perspective view of a first embodiment of the apparatus of the present invention shown in partial cross-section with a liquid receiving cup in the filling position;

FIG. 2 is a side elevational view of the first embodiment of the apparatus shown in partial cross-section with a liquid receiving cup in a release position;

FIG. 8 is a side elevational view of a fifth embodiment of the present invention shown in partial cross-section.

DETAILED DESCRIPTION OF THE PREFERRED EMBODIMENTS

Figure 3:
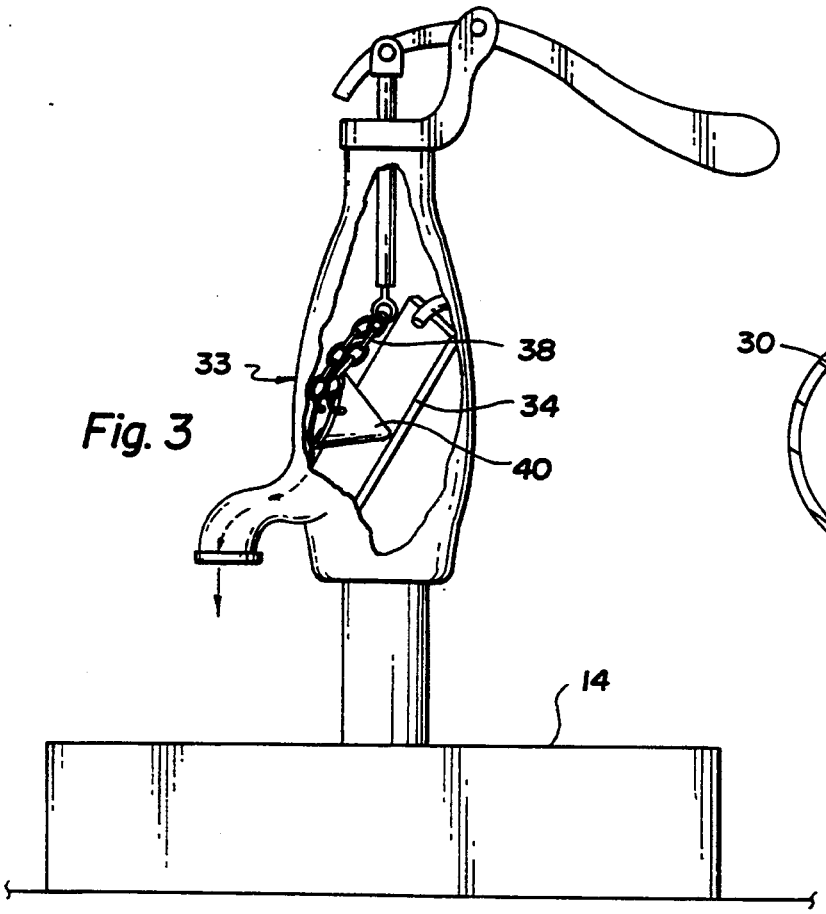
FIG. 3 is a side elevational view of the first embodiment of the apparatus shown in partial cross-section with a liquid receiving cup in an alternative release position.

With reference to FIGS. 1–3 of the drawings, there is provided a side elevational view of the first embodiment of present invention shown in partial cross-section. As shown, the apparatus is designated generally by reference numeral 10 and includes a housing 12, a base 14, a reservoir such as a pond or storage tank 16, and an electrical or mechanical water pump 18. As shown, tubing 20 connects reservoir 16 in fluid communication with pump 18. Similarly, tubing 22 is shown for providing pump 18 in fluid communication with housing interior 24. Housing 12 includes a spout 23 for permitting liquid, such as water, to be drained into reservoir 16. Applicant further contemplates that similar tubing may also be provided within housing 12 such that any liquid not released through spout 22 may be internally drained and returned to reservoir 16. In applications where it is undesirable to have any liquid flow externally, all released liquid may be drained internally and reservoir 16 may be hidden within base 14.

Still referring to FIGS. 1–3, it is seen that tubing 22 terminates in a nozzle or similar water release valve 26 for providing a stream of water 28 into housing interior 24 at a selected orientation and rate of flow. As shown, there is further provided a liquid receiving cup 30 preferably made of plastic or the like and of conical shape which is suspended from an actuating member such as pump handle 32. Pump handle 32 is affixable to the housing 12 and is preferably affixed substantially intermediate its ends 34 and 36. Pump handle 32 is selected such that it properly counterbalances liquid receiving cup 30 when in its initial filling position. It should also be noted that while a pump handle has been shown as the selected actuating member in FIGS. 1–3, any such member may be selected or utilized depending upon the display sought to be powered and the required counter balancing.

With reference still to FIGS. 1–3, attention is directed to distance limitation means 34 which may comprise, for example, an angularly mounted plane of plastic or wood disposed in housing interior 24. In operation, the weight of the liquid 28 received by cup 30 causes the cup to be lowered within housing interior 24 from a filling position generally designated by reference numeral 29 in FIG. 1 to alternative release positions designated by reference numerals 31 and 33 in FIGS. 2 and 3, respectively. With specific reference to FIG. 2, attention is directed to hanging means 38 shown affixable between the upper edge 40 of liquid receiving cup 30 and actuating member 32. Hanging means 38 may comprise a chain as shown in FIGS. 2 or 3 or, alternatively, a pair of rigid cords or wires or the like. While filling cup 30 is permitted to be lowered within the housing interior 24 by the weight of the received liquid yet restricted in rotational movement to a plane parallel the longitudinal axis of housing 12.

In the release position 31 shown in FIG. 2, hanging means 38 is shown affixed to cup 30 such that the cup is substantially centered thereabout. In operation, liquid and preferably water 28 is pumped from reservoir 16 into housing 12 where it is received by liquid receiving cup 30. As cup 30 fills with the received liquid, the increased weight of the liquid causes cup 30 to be lowered vertically within the housing interior 24 until it comes in contact with distance limitation means 34. At that point, distance limitation means 34 provides limited support for cup 30 which is caused to tip into housing interior 24 and release substantially all of the received liquid. As readily seen, following release of liquid 28, the counterweight of actuating member 32 causes liquid receiving cup 30 to travel upwardly and substantially vertically back to its filling position 29 where it will again receive liquid 28 through tubing 22 and be lowered and raised within housing interior 24 in a cyclical fashion. In this manner, actuating member 32 is oscillated in timed relation to the vertical movement of the liquid receiving cup 30 within the housing. It is noted that depending upon the selected counterweights of liquid receiving cup 30 and actuating member 32, the angular position of distance limitation means will necessarily be adjusted to provide the desired oscillation.

With reference now to FIG. 3 of the drawings, the apparatus of FIGS. 1 and 2 is shown in an alternative release position. As seen, in FIG. 3, hanging means 38 is affixed to the upper edge 40 of liquid receiving cup 30 substantially off-center such that as cup 30 is lowered within housing interior 24, it is caused to tip in substantially a counter-clockwise direction and release the retained fluid away from distance limitation means 34. In both of the release positions shown in FIGS. 2 and 3, the received liquid 28 is preferably released through spout 22 and returned to reservoir 16. However, internal draining means is contemplated in place of or in addition to spout 22, as discussed above.

Figure 4:
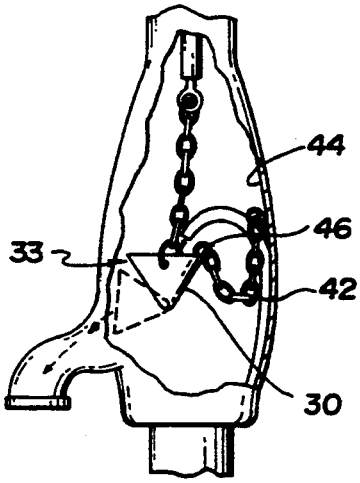
FIG. 4 is a side elevational view of a second embodiment of the present invention shown in partial cross-section.

With reference now to FIG. 4 of the drawings, there is shown a second embodiment of the apparatus of the present invention. In this embodiment, the distance limitation means provided comprises an elongate cord or chain 42 affixable between the inner wall 44 of housing interior 24 and the top edge 46 of one side of liquid receiving cup 30. In operation, as liquid receiving cup 30 is lowered within housing interior 24, chain 42 becomes taut causing cup 30 to tip over and release the retained liquid 28. At that point, the counterweight of actuating member 32 will again cause liquid receiving cup 30 to travel upwardly within housing interior 24 where it will be filled with liquid 28 and be lowered in the same cyclical fashion to its release position.

Figure 7:
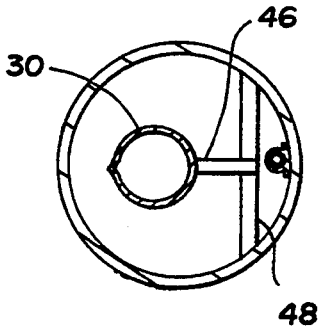
FIG. 7 is a top plan view of the embodiment of the present invention shown in FIG. 5.
Figure 5:
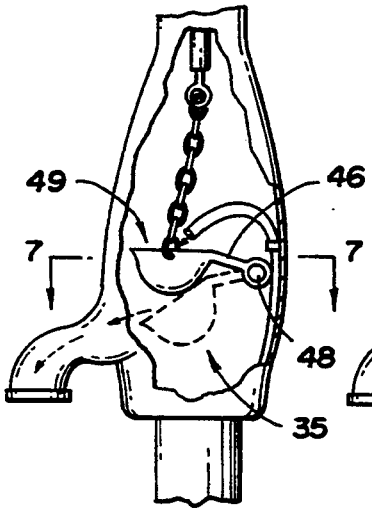
FIG. 5 is a side elevational view of a third embodiment of the present invention shown in partial cross-section.

With reference now to FIGS. 5 and 7 of the drawings, there is shown a third embodiment of the apparatus of the present invention. In this alternative embodiment, liquid receiving cup 30 further includes a retaining member 46 rotatably affixed to stationary member 48. Like the embodiments of FIGS. 1–4, in this embodiment, a liquid such as water 28 may be introduced into housing interior 24 where it is received by liquid receiving cup 30. As shown, however, retaining member 46 and stationary member 48 perform the distance limitation function of plane 38 and elongate chain 42 referenced in the embodiments above. As shown in more detail in FIG. 5, as the weight of the received liquid 28 causes liquid receiving cup 30 to be lowered vertically within housing interior 24, retaining member 4 is caused to be rotated counter-clockwise about stationary member 48 such that cup 30 is tipped and the received liquid 28 is released. This release position is shown in phantom lines designated by reference numeral 35. As in the case of the embodiment of FIG. 1, following release of liquid 28, cup 30 is rotated clockwise about stationary member 48 and returned to its filling position generally designated by reference numeral 49 within housing 24 by the counterweight of actuating member 32.

Figure 6:
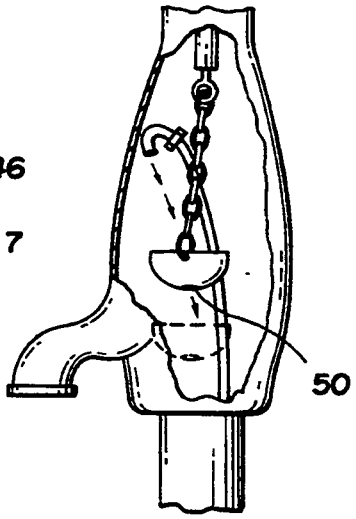
FIG. 6 is a side elevational view of a fourth embodiment of the present invention shown in partial cross-section.

With reference now to FIG. 6 of the drawings, there is shown yet another embodiment of the present invention wherein liquid receiving cup 30 includes an aperture 50 disposed therein for the direct release of received liquid 28 into housing interior 24. Applicant contemplates that any diameter or location of aperture 50 may be selected such that the rate of flow of liquid released by cup 30 is substantially slower than the rate of flow at which liquid is pumped into housing interior 24 by pumping means 18. In operation, it can be seen that as the weight of the received liquid 28 causes cup 30 to be lowered within housing interior 24, cup 30 falls below the stream of water introduced into the cavity to the point where it is substantially drained and thus caused to travel upwardly by the counterweight of actuating member 32. Again, any orientation and rate of flow of the pumped liquid 24 may be selected to achieve the intended purpose.

Referring now to FIG. 8 of the drawings, another embodiment of the present invention is shown. In this alternative embodiment, liquid receiving cup 30 further includes a retaining member 51. There is also provided a stationary member 53 disposed within housing interior 24 and preferably affixed to the inner wall 44. Stationary member 53 is adapted to receive retaining member 51. As in the previous embodiments of FIGS. 1–7, in this embodiment, a liquid such as water 28 may be introduced into housing interior 24 where it is received by liquid receiving cup 30. As shown, retaining member 51 and stationary member 53 perform the distance limitation function disclosed in previous embodiments. It can be seen that as the weight of the received liquid 28 causes liquid receiving cup 30 to be lowered vertically within housing 24, retaining member 51 is caused to contact stationary member 53 and rotate counterclockwise thereabout such that cup 30 is tipped and the received liquid 28 is released. As in the previous embodiments, following release of liquid 28, the counterweight of actuating member 32 causes cup 30 to travel vertically and return to its filling position.

Figure 9:
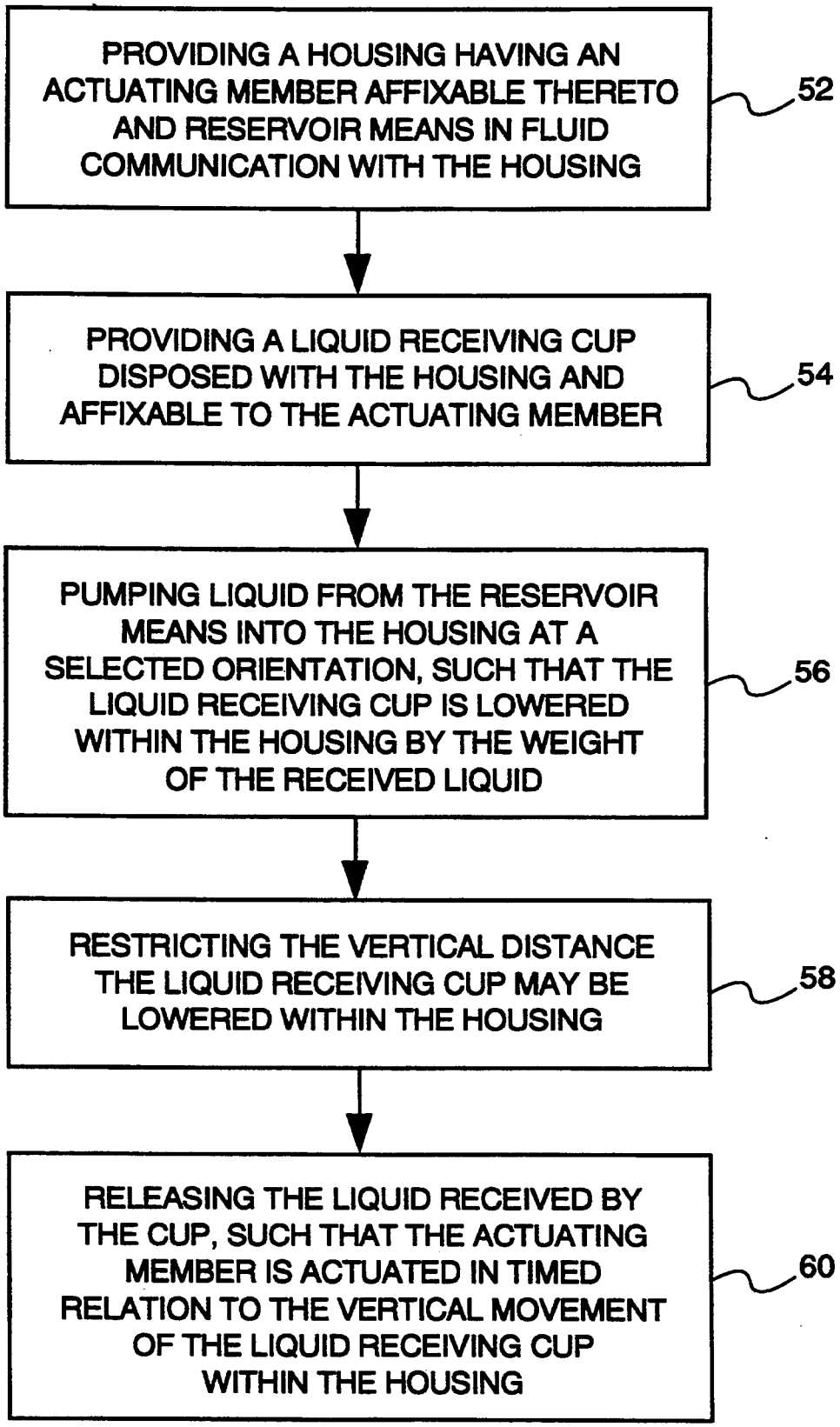
FIG. 9 is a flow chart of the method steps of the present invention.

With reference now to FIG. 9, the method steps of the present invention will now be described in further detail. As shown in the schematic, the method includes the steps of providing a housing having an actuating member as well as reservoir means in fluid communication with the housing. Still further, there is provided a liquid receiving cup disposed within the housing and affixable to the actuating member shown in blocks 52 and 54. In operation, liquid is pumped from the reservoir into the housing at a selected orientation and rate of flow for receipt by the liquid receiving cup. As the liquid is received, the cup is lowered within the housing by the weight of the liquid as referenced in block 56. The vertical distance liquid receiving cup may travel within the internal cavity of the housing is restricted and the liquid received by the cup is released such that the actuating member is actuated in timed relation to the vertical movement of the cup within the housing to power the display device. These steps are referenced in blocks 58 and 60 any may further include the provision of an aperture within the liquid receiving cup adapted to release the liquid at a rate of flow substantially slower than the selected rate of flow at which the liquid is pumped into the housing.

While the best modes for carrying out the present invention have been described in detail, those familiar with the art to which this invention relates will recognize various alternative designs and embodiments for practicing the invention as defined by the following claims.

What is claimed is:

1. An apparatus for hydraulically powering a moving display, comprising:

a housing having an actuating member affixed thereto;

reservoir means in fluid communication with said housing for storing a liquid;

pump means in fluid communication with said reservoir means and said housing for pumping said liquid into said housing at a selected orientation and rate of flow:

a liquid receiving cup disposed within said housing, said cup affixed to said actuating member, the weight of said cup providing a means for counterbalancing the weight of said actuating member, said cup adapted to be lowered within said housing by the weight of said liquid; and distance limitation means affixed to said housing and proximate to said liquid receiving cup for restricting a vertical distance said cup may travel within said housing and facilitating the release of said liquid, wherein said actuating member is actuated in timed relation to the movement of said cup within said housing to power said display.

2. A moving display device as in claim 1, wherein said distance limitation means comprises:

a stationary member affixed to said housing; and a retaining member having a first end affixed to said liquid receiving cup and a secondary end rotatably affixable to said stationary member.

3. A moving display device as in claim 1, wherein said distance limitation means comprises:

a retaining member having a first end affixed to said liquid receiving cup and a second end; and a stationary member disposed within said housing and adapted to receive said retaining member second end.

4. A moving display device as in claim 1, wherein said distance limitation means comprises an elongate cord having a first end affixable to said housing and a second end affixable to said liquid receiving cup.

5. The apparatus of claim 1, wherein said distance limitation means comprises a plane disposed within said housing.

6. The apparatus of claim 5, wherein said plane is disposed within said housing at a substantially 45 degree angle.

7. A moving display device as in claim 1, wherein said distance limitation means comprises an aperture disposed in said liquid receiving cup adapted to release said liquid at a rate of flow substantially slower than said selected rate of flow at which said liquid is pumped into said housing.

8. The apparatus of claim 1, wherein said actuating member comprises a pump handle having a first end and a second end, said pump handle pivotally mounted to said housing intermediate said first and second ends to permit oscillating movemenn in a plane parallel to a longitudinal axis of said housing.

* * * * *